United States Patent [19]

Nailor et al.

[11] 4,333,392

[45] Jun. 8, 1982

[54] FIRE DAMPER

[76] Inventors: Michael T. Nailor, 189 Old Yonge St., Willowdale, Ontario, Canada, M2P 1R2; Andrew J. Hart, 15 - 33 Four Winds Dr., Downsview, Ontario, Canada, M3J 1K7

[21] Appl. No.: 111,619

[22] Filed: Jan. 14, 1980

[51] Int. Cl.[3] ..... E05F 15/20

[52] U.S. Cl. ..... 98/1; 160/1

[58] Field of Search ..... 98/1; 160/1, 5, 6, 84 R, 160/235 S; 137/74, 75; 292/340, 346, 128

[56] References Cited

U.S. PATENT DOCUMENTS

| | | | |
|---|---|---|---|
| 1,998,124 | 4/1935 | Eisenman | 292/340 X |
| 3,525,378 | 8/1970 | Rout | 160/1 |
| 3,747,662 | 7/1973 | Kurz | 160/1 |
| 3,907,020 | 9/1975 | Rout | 160/1 |
| 4,175,607 | 11/1979 | Tatum et al. | 160/1 |

FOREIGN PATENT DOCUMENTS

| | | | |
|---|---|---|---|
| 982901 | 2/1976 | Canada | 160/1 |

*Primary Examiner*—Albert J. Makay
*Assistant Examiner*—Harold Joyce
*Attorney, Agent, or Firm*—Rogers, Bereskin & Parr

[57] ABSTRACT

Fire dampers are disclosed for use in air ducts to arrest the flow of gases and flame through the ducts in the event of a fire. The dampers each include a frame defining a generally rectangular central opening and a plurality of blades which are normally disposed in a folded position at one side of the frame but which can be moved by spring means to an unfolded position in which they extend across the opening of the frame in the event of a fire. A fusible link means normally retains the blades in their folded position. Locking members are provided for retaining the blades in their unfolded position after they have been released by the fusible link means. In one embodiment, the locking members engage integral tabs formed on the endmost blade. In another embodiment, the endmost blade has an end portion which is deflected at an acute angle with respect to the remainder of the blade and which engages over locking brackets secured to the frame.

7 Claims, 11 Drawing Figures

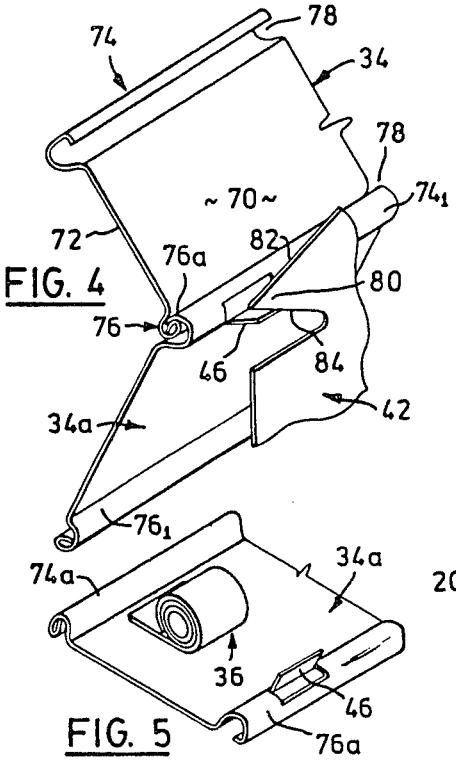
FIG. 4
FIG. 5
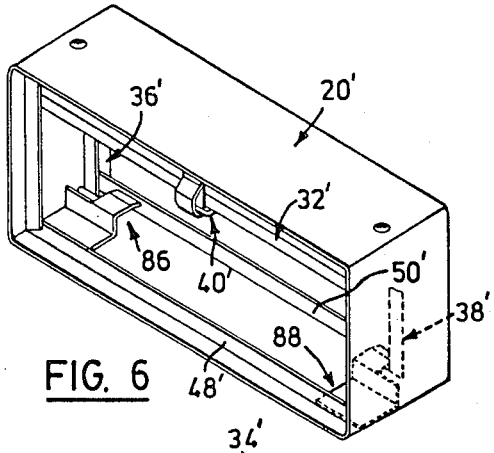
FIG. 6
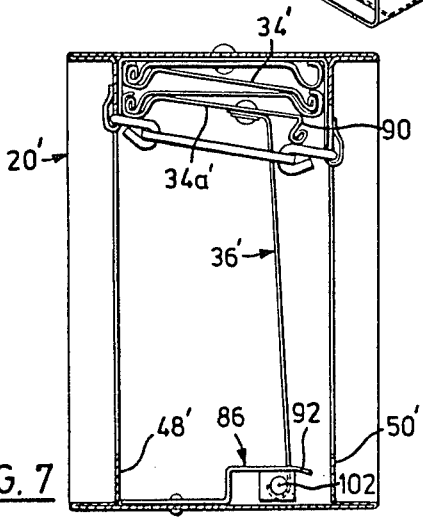
FIG. 7
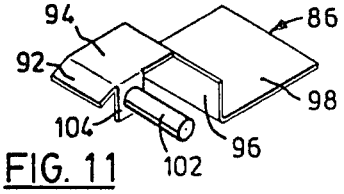
FIG. 11

FIRE DAMPER

This invention relates to fire dampers used in air ducts to arrest the flow of flame and gases through the ducts in the event of a fire.

Fire dampers typically include a frame defining a generally rectangular central opening and an assembly of pivotally interconnected blades which are coupled to the frame and are spring biassed to a position in which they extent across the frame and close the opening for preventing the flow of flames and gases through the frame. The blades are normally held in a folded condition at one side of the frame against their spring biassing by a fusible link. When the damper is exposed to heat in a fire, the link will melt, releasing the blades and allowing them to move to their unfolded position under the effect of their spring biassing.

It will be appreciated that, in a fire, such dampers may be exposed to high temperatures for extended periods of time. In practice, this causes the frame and/or the blades to buckle with the result that the blades may tend to open and allow flames and gases to pass along the air duct. Mechanical locking arrangements are therefore provided for holding the blades in the unfolded position. In many jurisdictions, building codes require that such locking arrangements be employed and fire dampers are required to be able to withstand prescribed temperature conditions without the blades opening, in some cases even when jets of water are played on the hot damper.

Canadian Pat. No. 982,901 (Kurz) discloses an example of a prior art blade locking arrangement. In that case, a catch is fixed to the frame of the damper and is arranged to engage in an opening in one of the blades as the blades move to their unfolded position. This locking arrangement has a severe disadvantage in that it essentially requires an opening in one of the blades through which flames and hot gases can leak. In other words, the integrity of the blade assembly is destroyed. Also, it is found in practice that the security of engagement of the catch member in the blade opening is poor and that disengagement may in fact occur as the damper buckles when exposed to high temperatures. Another, somewhat similar arrangement having the same disadvantages is disclosed in U.S. Pat. No. 3,747,662 (Kurz) in association with relatively small size fire dampers.

Another example of a prior art blade locking arrangement is disclosed in U.S. Pat. No. 3,907,020 (Root). In that case, a catch secured to the damper frame receives the end edge of the outermost blade in the assembly for the purpose of holding the blades in their unfolded position. Again, this arrangement has been found to provide insufficiently secure locking of the blades when the damper is exposed to high temperatures.

An object of the present invention is to provide fire dampers having improved blade locking arrangements.

According to one aspect of the invention, the damper includes a frame defining a generally rectangular central opening and having first and second ends and two opposite sides. A blade assembly is coupled to the first end of the frame and includes a plurality of generally rectangular blades pivotally connected together end-to-end for movement relative to one another between a position in which the blades are disposed in a folded configuration at said first end of the frame, whereby the frame opening is unobstructed, and a position in which the blades are unfolded and extend across and close the opening. The blades are biassed towards the unfolded position by spring means and are normally retained in the folded position by fusible link means adapted, when exposed to a predetermined high temperature, to release the blades and allow them to move to said unfolded position under the influence of the said spring means. Means is also provided for retaining the blade assembly in the unfolded position after the blades have been released by the fusible link means. Each blade has a planar central portion having side edges for co-operation with the sides of the frame, and opposite end edge portions each of arcuate shape in cross-section and extending longitudinally of the relevant edge of the blade so as to define a formation of part cylindrical shape engagable with a similar edge portion of an adjacent blade for defining a pivotal connection between the blades. The blade assembly includes an endmost blade which is disposed adjacent the second end of the frame in the unfolded position of the blades, with an outer one of its arcuate end edge portions in co-operation with the second end of the frame, and an inner one of its edge portions spaced inwardly of the frame and pivotally connected to an adjacent blade in the assembly. The retaining means comprises at least one locking member secured to the frame adjacent the second end thereof and defining a locking projection, and an integral tab portion formed from part of the inner arcuate end edge portion of the endmost blade of the blade assembly and positioned to engage behind the projection as the blade assembly moves from its folded position to its unfolded position. The tab and projection positively lock the blade assembly in its unfolded position and the co-operating part cylindrical end edge portion of said adjacent blade in the assembly serves to prevent passage of flame and gases through the portion of the endmost blade from which the tab is formed.

According to another aspect of the invention, the retaining means may alternatively comprise at least one locking member secured to the frame and defining a locking projection spaced from but directed towards the second end of the frame, and an end portion of the endmost blade of the blade assembly which is deflected out of the general plane containing the remainder of the blade about a line disposed generally parallel to the outer arcuate edge portion of the blade so that said end portion defines an acute angle with respect to the remainder of the blade and is engagable over the locking projection as the blade assembly moves from its folded position to its unfolded position, whereby the end portion of the blade and the projection co-operate to retain the blade assembly in its unfolded position.

This latter form of retaining means is particularly suitable for relatively small size fire dampers (typically of, say, 8 inches in height) although it is to be understood that there is no limitation in this respect.

In order that the invention may be more clearly understood, reference will now be made the accompanying drawings which illustrate a number embodiments of the invention by way of example, and in which:

FIG. 4 is a detail perspective view showing the blade locking member and co-operating blade tab portion of the damper shown in FIG. 3;

FIG. 5 is a perspective view of the endmost blade in the blade assembly of the damper shown in the previous views;

FIG. 6 is a perspective view of a fire damper according to a second embodiment of the invention, showing the blades of the damper in their folded position;

FIG. 7 is a vertical sectional view through the damper of FIG. 6;

The embodiment of the invention shown in FIGS. 1 to 5 is designed primarily for relatively large fire dampers (which might be of a size up to or even greater than 5'×5') while the embodiment shown in the remaining figures is intended primarily for small fire dampers (e.g. having a height of 8" or less). However, it is to be understood that the respective embodiments are not limited to these particular sizes.

Figure 2:
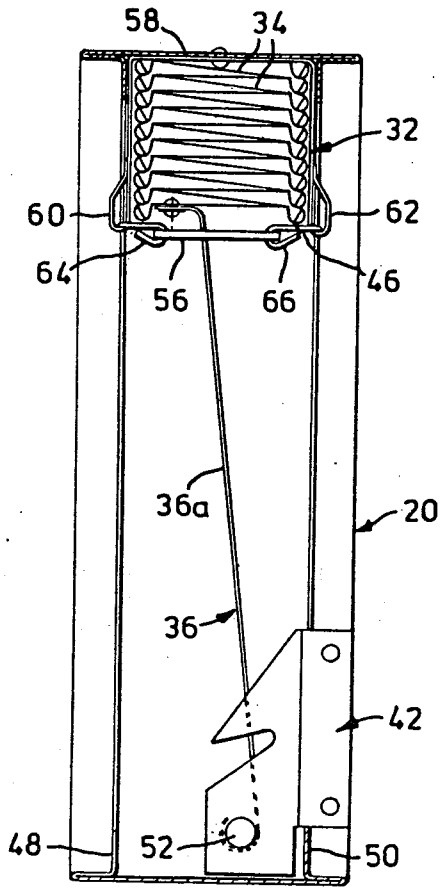
FIG. 2 is a vertical sectional view through the fire damper of FIG. 1.
Figure 1:
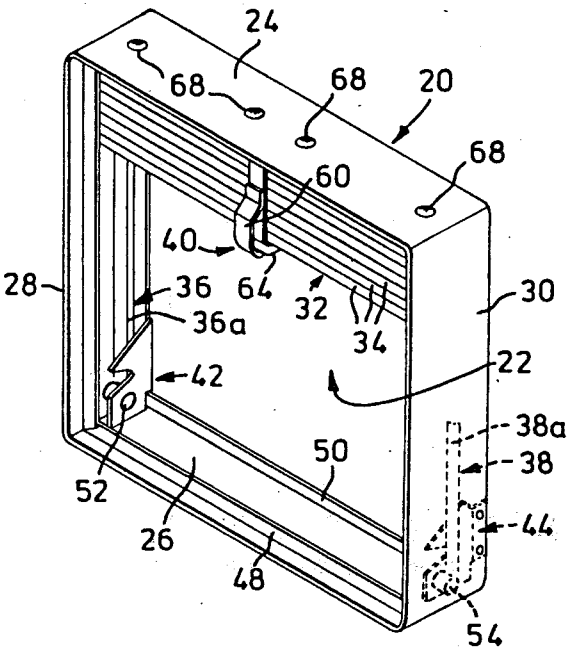
FIG. 1 is a perspective view of a fire damper according to a first embodiment of the invention, the blades of the damper being shown in their folded position.

Referring first to FIG. 1, the damper includes a frame 20 having a generally rectangular central opening 22 and having first and second ends 24 and 26 respectively and two opposite sides 28 and 30. A blade assembly 32 is coupled to the first end 24 of the frame and includes a plurality of generally rectangular blades 34 (see also FIGS. 2 and 3) which are pivotally connected together end-to-end for movement relative to one another between the folded position in which the blades are shown in FIGS. 1 and 2, in which the central opening of the frame is unobstructed, and the unfolded position shown in FIG. 3 in which the blades extend across and close the opening for preventing transmission of gases and flame through the frame.

Figure 3:
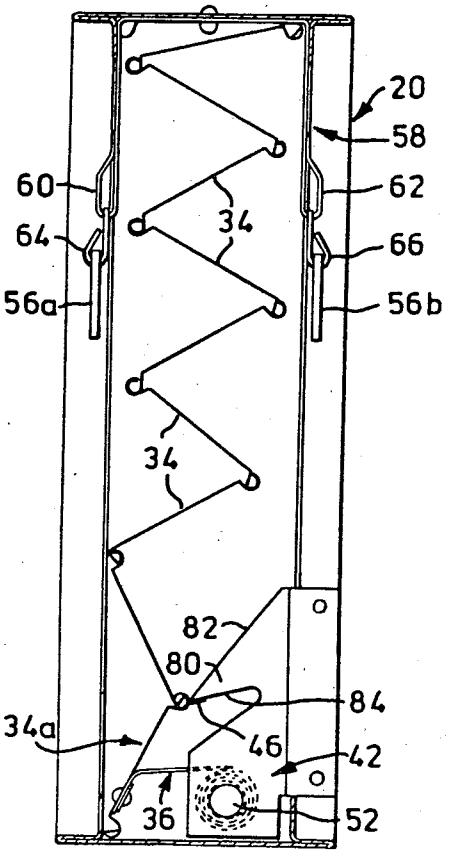
FIG. 3 is a view similar to FIG. 2 showing the blades of the damper in their unfolded position.

Springs generally indicated at 36 and 38 are provided for biassing the blades toward their unfolded position but the blades are normally retained in their folded position by fusible link means generally indicated at 40 and adapted, when exposed to a predetermined high temperature, to release the blades and allow them to move to their unfolded position under the influence of the springs 36 and 38. The blades can be retained in their unfolded position after they have been released by the fusible link means by locking members generally indicated at 42 and 44 which are engagable with tabs on the endmost blade in the blade assembly 32. In FIG. 3, this endmost blade is indicated at 34*a* and has a tab 46 shown engaged with locking member 42.

Having described the principal components of the damper in general terms, it may now be convenient to describe these components in more specific terms. Referring back to FIG. 1, the damper frame 20 is formed from a folded sheet metal blank into the square configuration shown in FIG. 1. The blank from which the frame is formed has two parallel longitudinal flanges, parts of which are visible at 48 and 50 in FIG. 2. The blank is folded so that the flanges are directed inwardly of the resulting rectangular frame and the frame is retained in its rectangular folded configuration by a suitable bracket (not shown) secured to respectively opposite ends of the blank as well known in the art. The flanges 48 and 50 are spaced transversely of the blank by an extent slightly greater than the width of the blade assembly in its folded position as can clearly be seen in FIG. 2. The flanges accordingly serve to constrain the folded blades and also serve to guide the blades as they move from their folded position to their unfolded position.

The springs 36 and 38 used to bias the blades to their unfolded position are constant tension springs of the type manufactured by the Hunter Spring Company of Lansdale, Pa., U.S.A. under the trade mark NEGATOR. Such springs are conventionally used in fire dampers and will not therefore be described in detail. For present purposes, it is sufficient to note that each spring comprises a flat strip of spring material and a spindle to which one end of the strip is attached. When the spring is relaxed, the strip adopts a coiled configuration around the spindle; as shown in FIGS. 1 and 2, the strips are extended under tension and tend to draw the blades into their unfolded position (downwardly in the frame as shown). The strips of the respective springs are designated 36*a* and 38*a* and the associated spindles are indicated at 52 and 54. It will be seen that each spindle is disposed adjacent the second (lower) end of the damper frame and is in fact mounted between the relevant side of the frame and the adjacent blade locking member (42 or 44). The two spring strips extend outwardly from the respective spindles generally parallel to one another and are rivetted at their outer ends to the endmost blade 34*a* in the blade assembly 32 (FIG. 2).

The fusible link means 40 referred to above is also of conventional form. It includes a link 56 of a metal which will melt at a predetermined high temperature (e.g. 160° F.) and which forms part of a strap encircling the assembly of folded blades. In this case, the remainder of the strap is formed by a metal strip 58 which is generally U-shaped and which has hooks 60 and 62 at its outer ends to which the fusible link is coupled by wire hooks 64 and 66. The strap extends over the the top of the blade assembly and is trapped between the uppermost blade and the frame by rivets 68 used to secure the inner end blade of the assembly to the frame.

FIG. 3 shows the fire damper in the condition in which the fusible link 56 has parted, allowing the springs 36 and 38 to draw the blades downwardly into their unfolded position. The remaining parts of the link are visible at 56*a* and 56*b* in that view.

Reference will now be made primarily to FIGS. 4 and 5 in describing the blades 34. FIG. 5 shows the endmost blade 34*a* in the blade assembly. This blade is the same as the other blades except for the presence of the tab portions which engage the locking members 42 and 44. Tab portion 46 is visible in FIG. 5. In FIG. 4, this endmost blade 34*a* is shown in association with the adjacent blade in the assembly. This adjacent blade will now be described as being representative of all of the blades.

Each blade includes a planar central portion 70 having side edges for co-operation with the sides 28 and 30 of the frame. One of these side edges is visible at 72 in FIG. 4. It will of course be appreciated that each blade should be of a width to fit fairly closely between the sides of the frame so as to minimize the risk of leakage of gases between the blades and the frame. The blade also has opposite end edge portions 74 and 76, each of arcuate shape in cross-section and extending longitudinally of the relevant edge so as to define a formation of part cylindrical shape engagable with a similar edge portion of an adjacent blade for defining the pivotal connection between the blades. In other words, each of these part cylindrical formations defines a longitudinal slot 78 into which a similar formation on an adjacent blade can be engaged. The two slots open at the same side of the blade and adjacent blades are reversed with respect to one another so that the blades define a zig-zag or concerting-like configuration when assembled together. In this embodiment, the end portion 76 of each blade defines a slightly smaller arc than end portion 74 and has an outer edge portion **76*a*** which is rolled over to define a rounded surface on which the end edge portion of an adjacent blade can pivot as the blades move with respect to one another. This arrangement makes for a smooth pivoting action and practically eliminates the possibility of jamming of the blades, although it is not essential.

With continued reference to FIG. 4, it will be seen that the outer arcuate end edge portion $76_1$ of the endmost blade **34*a* co-operates with the second end 26 of the frame when the blades are in their unfolded position and that the inner end edge portion $74_1$ is spaced inwardly of the frame and pivotally connected to the adjacent blade in the assembly. This inner end edge portion 74 of the endmost blade 34*a* is formed with the integral tab portion 46 referred to above, which co-operates with locking member 42, and with a second similar tab portion (not shown) at a position corresponding to the position of the second locking member 44 (FIG. 1). Each of these tab portions is of generally rectangular shape and is formed by cutting a generally rectangular flap from the material of the blade which forms portion $74_1$ and bending the flap outwardly to the appropriate angular position. As can best be seen in FIG. 3**, this flap should preferably be directed upwardly at a slight inclination to the horizontal when the blades are in their unfolded position.

Locking member 42 is also visible in FIG. 4. It will be seen that the locking member defines a locking projection 80 behind which the tab portion 46 engages. Projection 80 is defined by two surfaces 82 and 84 of the locking member disposed at an acute angle with respect to one another. Surface 82, in co-operation with the corresponding surface of the other locking member 44 exerts a "camming" action on the blade assembly as the blades move to their unfolded position. Thus, these surfaces tend to force the two end blades (blade **34*a* and the adjacent blade) towards the relevant of one the inwardly directed flanges which extend around the damper frame (in this case flange 48). Because the springs 36 and 38 are mounted directly adjacent the locking members 42 and 44, this camming action takes place against the biassing effect of the springs 36 and 38. Accordingly, the springs tend to ensure that the tab portions (as portion 46) of the blade are firmly engaged with the locking member (42 or 44**) but that, at the same time, the endmost blade is urged firmly against the frame and makes a good seal therewith.

It has been found in practice that the described locking arrangement provides for secure and firm retention of the blades in their unfolded position even when the damper is exposed to extremely high temperatures for extended periods of time and even if cold water is played on the damper at this time.

Reference will now be made to FIGS. 6 to 10 describing the second embodiment of the invention as applied to small dampers. Primed reference numerals will be used to denote corresponding parts.

Figure 8:
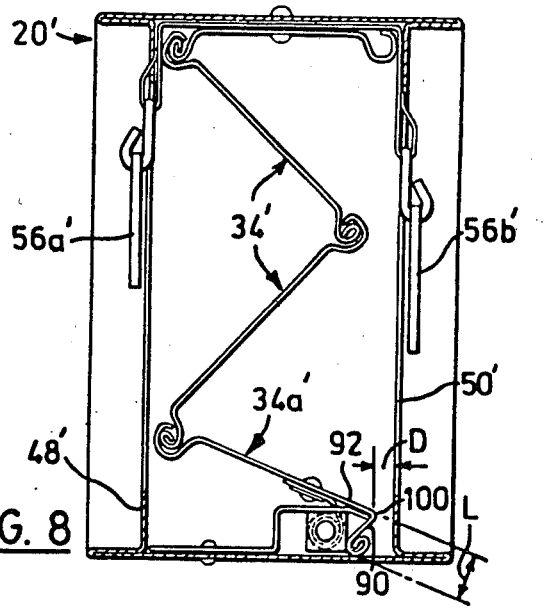
FIG. 8 is a view similar to FIG. 7 showing the blades in their unfolded position.

FIG. 6 shows the damper in perspective. It has a frame 20' which is constructed in essentially the same manner as the frame 20 of FIG. 1 and which has inwardly directed flanges 48' and 50'. An assembly of folded blades is indicated at 32' and is held in the folded configuration by fusible link means 40'. Springs tending to bias the blades to their unfolded position are indicated at 36' and 38'. FIGS. 7 and 8 illustrate the fact that there are a smaller number of blades than in the damper of the previous embodiment although the blades are essentially of similar general shape. They are individually denoted 34' and the endmost blade is denoted **34*a*'**.

The primary difference between the embodiment of FIGS. 6 to 10 and the embodiment of the previous views resides in the means used for retaining the blades in their unfolded position after they have been released by the fusible link means. In this embodiment, the retaining means comprises two locking members denoted 86 and 88 which are of somewhat different form from the locking members of the first embodiment. Also, instead of the tab portions provided on the endmost blade in the blade assembly, in this case, the endmost blade has an end portion, denoted 90 which is deflected out of the general plane containing the remainder of the blade about a line disposed generally parallel to the outer arcuate edge portion of the blade so that the end portion defines an acute angle with respect to the remainder of the blade and is engagable with the locking members. The locking members themselves are also of somewhat different form and each member includes a locking projection spaced from but directly towards the second end of the frame over which the end portion of the endmost blade is engaged.

Locking member 86 is shown individually in FIG. 11; member 88 is the same but of opposite hand. The locking projection referred to about is indicated at 92 and is formed as a downwardly deflected outer end portion of an upper limb 94 of the member. The member also includes an upright portion 96 and a base portion 98 by which the member is secured to the frame (by welding). FIGS. 7 to 10 clearly illustrate the position of locking member 86 as installed and the fact that its locking projection 92 is directed downwardly towards the second end of the frame. The angle of deflection of this portion is selected to correspond generally to the inclination of the main part of the endmost blade **34*a*'** when the blades are in their unfolded position.

As indicated above, the end portion 90 of blade **34*a*' is deflected out of the general plane containing the remainder of the blade. This is accomplished by a simple folding operation about a line spaced inwardly to an appropriate extent from the outer end of the blade. The position of the fold line is selected so that the length of this end portion, denoted L in FIG. 8, is greater than the distance between the frame flange 50' and the outer end of the locking projection 92 of locking member 86. This dimension is indicated at D in FIG. 8. This relative dimensioning of the respective parts ensures that the deflected end portion of blade 34*a*' cannot be disengaged from the locking member simply by vertically displacing the blade. Similarly, the blade cannot be engaged with a locking member by simple downward vertical movement but must in effect be hooked over the locking member. In order to accomplish this effect, the spindles for the springs 36' and 38' are mounted on the respective locking members and are spaced laterally inwardly from the outer end of the locking projection of the member. FIG. 11 shows the spindle for spring 36', which is denoted 102. It will be seen that the member projects outwardly from a tab 104 dependent from an upper limb 94 of member 86**.

Figure 9:
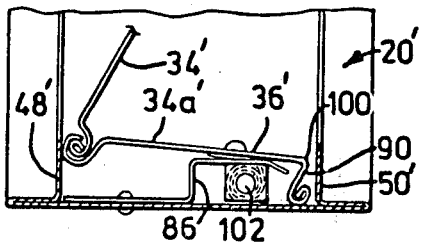
FIG. 9 is a view similar to part of FIG. 8 showing the endmost blade in a "transient" position just before it reaches the fully locked position shown in FIG. 8.

Referring back to FIG. 7, it will be seen that the spring 36' (and the other spring 38') is attached to the endmost blade 34*a'* at a position substantially directly above the spindle 102 of the spring. As a result of this and of the positioning of the spring spindle, when the blades are released, the endmost blade 34*a'* tends to remain in a generally horizontal attitude as it is brought down by the springs. This allows the end portion 90 of the blade to pass easily between the locking projection 92 and the flange 50' of frame 20'. FIG. 9 shows the endmost blade in an transient position just after it has reached the bottom of its travel and it will be appreciated from that view that the blade end portion 90 will have readily engaged behind the locking projections of the locking members. The springs will then tend to pull the endmost blade 34*a'* slightly to the left as shown in the drawings (towards flange 48') so that the blades will finally adopt the configuration shown in FIG. 8.

Figure 10:
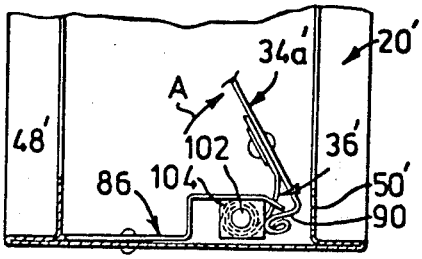
FIG. 10 is a view similar to FIG. 9 showing how the endmost blade locks even more firmly in the event of a fire; and, FIG. 11 is a detail view of the locking member used in the damper of FIGS. 6 to 10.

The locking arrangement described has been found to be eminently satisfactory in terms of ensuring secure locking of the blades in their unfolded position, even at high temperatures. Referring to FIG. 10, it has been found that the buckling of the blades which takes place at such temperatures tends to cause the endmost blade 34*a* to pivot somewhat in a direction indicated by arrow A in FIG. 10 so that the end portion 90 of the blade tends to become even more tightly wedged below the locking projections of the locking members. It will of course be appreciated that the preceding description relates to particular embodiments and that many modifications are possible within the broad scope of the invention. For example, the specific forms of spring referred to for moving the blades to their unfolded position are not essential. Also, fusible link means of other forms may be employed.

We claim:

1. A fire damper comprising:

a frame defining a generally rectangular central opening and having first and second ends and two opposite sides;

a blade assembly coupled to said first end of the frame and including a plurality of generally rectangular blades pivotally connected together end to end for movement relative to one another between a position in which the blades are disposed in a folded configuration at said first end of the frame, whereby said frame opening is unobstructed, and a position in which the blades are unfolded and extend across and close said opening;

spring means biassing said blades toward said unfolded position;

fusible link means normally retaining said blades in said folded position and adapted, when exposed to a predetermined high temperature, to release the blades and allow them to move to said unfolded position under the influence of said spring means; and, means adapted to retain said blade assembly in said unfolded position after the blades have been released by said fusible link means;

each said blade comprising a planar central portion having side edges for co-operation with said sides of said frame and opposite end edge portions each of arcuate shape in cross-section and extending longitudinally of the relevant edge of the blade so as to define a formation of part cylindrical shape engaged with a similar edge portion of an adjacent blade for defining said pivotal connection between the blades, and said blade assembly including an endmost blade which is disposed adjacent said second end of the frame in the unfolded position of the blades with an outer one of its said arcuate end edge portions in co-operation with said second end of the frame and an inner one of its said edge portions spaced inwardly of the frame and pivotally connected to an adjacent blade in said assembly by engagement of said arcuate end edge portion around a corresponding arcuate end edge portion of said adjacent blade;

said retaining means comprising at least one locking member secured to said frame adjacent said second end thereof and defining a locking projection, and an integral tab portion formed from part of said inner arcuate end edge portion of said endmost blade of the blade assembly and positioned to engage behind said projection as the blade assembly moves from its folded position to its unfolded position, whereby said tab and projection positively lock the blade assembly in said unfolded position and the co-operating part cylindrical end edge portion of said adjacent blade in said assembly serves to prevent passage of flame and gases through said portion of the endmost blade from which said tab is formed.

2. A damper as claimed in claim 1, wherein said retaining means comprises two of said integral tab portions formed from part of the inner arcuate end edge portion of the inmost blade at positions disposed adjacent respectively opposite side edges of the blade, and two said locking members spaced transversely of the frame by an extent corresponding to the spacing of said tab portions.

3. A damper as claimed in claim 2, wherein said frame includes a pair of spaced, inwardly directed flanges extending around said central opening of the frame and serving to constrain said blades in their folded position and to guide the blades in moving to their unfolded position, and wherein each of said locking members is of plate form and includes first and second edges disposed at an acute angle with respect to one another and defining said locking projection, said first edges of the respective locking members being disposed in the path of said endmost blade as the blades from their folded position to the unfolded position and being arranged to bias said end most blade towards a portion of the relevant one of said flanges disposed at said second end of the frame for ensuring sealing engagement between the blade and said flange portion.

4. A damper as claimed in claim 2, wherein said spring means comprises first and second constant tension springs each comprising a spindle and a strip-form spring member attached at one end to said spindle and at its opposite end to said endmost blade, and wherein the spindles of the respective springs extend between the respective locking members and the adjacent side of said frame.

5. A fire damper comprising:

a frame defining a generally rectangular central opening and having first and second ends and two opposite sides;

a blade assembly coupled to said first end of the frame and including a plurality of generally rectangular blades pivotally connected together end to end for movement relative to one another between a position in which the blades are disposed in a folded configuration at said first end of the frame, whereby said frame opening is unobstructed, and a position in which the blades are unfolded and extend across and close said opening;

said frame including a pair of spaced, inwardly directed flanges extending around said opening of the frame and serving to constrain said blades when in their folded position and to guide the blades in moving towards said unfolded position;

spring means biassing said blades toward said unfolded position;

fusible link means normally retaining said blades in said folded position and adapted, when exposed to a predetermined high temperature, to release the blades and allow them to move to said unfolded position under the influence of said spring means; and, means adapted to retain said blade assembly in said unfolded position after the blades have been released by said fusible link means;

each said blade comprising a planar central portion having side edges for co-operation with said sides of said frame and opposite end edge portions each of arcuate shape in cross-section and extending longitudinally of the relevant edge of the blade so as to define a formation of part cylindrical shape engaged with a similar edge portion of an adjacent blade for defining said pivotal connection between the blades, and said blade assembly including an endmost blade which is disposed adjacent said second end of the frame in the unfolded position of the blades with an outer one of its said arcuate end edge portions in co-operation with said second end of the frame and an inner one of its said edge portions spaced inwardly of the frame and pivotally connected to an adjacent blade in said assembly;

said retaining means comprising: two locking members secured to said frame and defining respective locking projections spaced from but directed towards said second end of the frame; and an end portion of said endmost blade which is deflected at an acute angle with respect to the general plane containing the remainder of the blade about a line extending across said planar central portion of the blade generally parallel to said outer arcuate edge portion and at a predetermined distance therefrom representing the length of said blade end portion, said endmost blade being engagable over said locking projections as the blade assembly moves from its folded position to its unfolded position, and said locking projections being oriented to thereupon engage in said acute angle defined between said end portion of the endmost blade and the remainder of said blade and retain the blade assembly in said unfolded position, said locking members being spaced transversely of the frame and positioned for engagement by said end portion of the endmost blade at positions adjacent respectively opposite side edges of the blade, and each said locking member comprising a bracket secured to said second end of the frame and having an upper limb spaced from said frame end and including an outer end forming one of said locking projections and which is spaced from the adjacent one of said inwardly directed flanges of the frame and defines a gap therewith, said spring means being adapted to cause the blades to move towards said unfolded position with the end portion of the endmost blade oriented to pass through said gaps and engage said locking projections and said gaps each being of a dimension slightly less than the length of the end portion of the endmost blade, so that said blade end portion is prevented from subsequently disengaging from said projections.

6. A damper as claimed in claim 5, wherein said spring means comprises two springs each including a spindle and a strip-form spring member attached at one end to said spindle and at its opposite end to said endmost blade, and wherein each of said spindles is carried by one of said brackets forming said locking members.

7. A damper as claimed in claim 6, wherein said springs are arranged so that the position of attachment of each spring to said endmost blade is substantially aligned with the spindle of the same spring in a plane generally parallel to said flanges of the frame.

* * * * *